US006052087A

United States Patent [19]

Ishikawa et al.

[11] Patent Number: 6,052,087

[45] Date of Patent: Apr. 18, 2000

[54] ANTENNA DEVICE AND RADAR MODULE

[75] Inventors: Yohei Ishikawa, Kyoto; Koichi Sakamoto, Nagaokakyo; Kenichi Iio, Nagaokakyo; Hideaki Yamada, Nagaokakyo, all of Japan

[73] Assignee: Murata Manufacturing Co., Ltd., Japan

[21] Appl. No.: 09/056,950

[22] Filed: Apr. 8, 1998

[30] Foreign Application Priority Data

Apr. 10, 1997 [JP] Japan ..... 9-092325
Mar. 11, 1998 [JP] Japan ..... 10-059607

[51] Int. Cl.[7] ..... H01Q 1/32

[52] U.S. Cl. ..... 343/700 MS; 333/202

[58] Field of Search ..... 343/700 MS, 753, 343/783, 909, 911 R; 333/202, 219, 219.1, 208, 248

[56] References Cited

U.S. PATENT DOCUMENTS

| | | | |
|---|---|---|---|
| 4,019,161 | 4/1977 | Kimura et al. | 333/82 B |
| 5,539,420 | 7/1996 | Dusseux et al. | 343/761 |
| 5,583,523 | 12/1996 | Wallace, Jr. | 343/741 |
| 5,764,116 | 6/1998 | Ishikawa et al. | 333/202 |
| 5,874,922 | 2/1999 | Tanaka | 343/753 |

FOREIGN PATENT DOCUMENTS

| | | |
|---|---|---|
| 0426972 | 5/1991 | European Pat. Off. . |
| 0735604 | 10/1996 | European Pat. Off. . |
| 0743697 | 11/1996 | European Pat. Off. . |
| 19600516 | 7/1996 | Germany . |
| 8191211 | 7/1996 | Japan . |

OTHER PUBLICATIONS

Patent Abstracts of Japan vol. 097, No. 005, May 30, 1997.

*Primary Examiner*—Don Wong
*Assistant Examiner*—James Clinger
*Attorney, Agent, or Firm*—Ostrolenk, Faber, Gerb & Soffen, LLP

[57] ABSTRACT

The invention provides an antenna in which a signal is directly transferred from a planar dielectric transmission line to a primary radiator without having to perform transmission mode conversion from the planar dielectric transmission mode to another mode such as a coplanar transmission mode, a microstrip transmission mode, or a waveguide transmission mode thereby eliminating the transmission loss which would otherwise occur due to the transmission mode conversion. A dielectric resonator is disposed in the vicinity of the end of the planar dielectric transmission line PDTL formed between two slots disposed on both sides of a dielectric plate. Furthermore, a slotted plate, a lens supporting base, and a dielectric lens are disposed one on another.

6 Claims, 8 Drawing Sheets

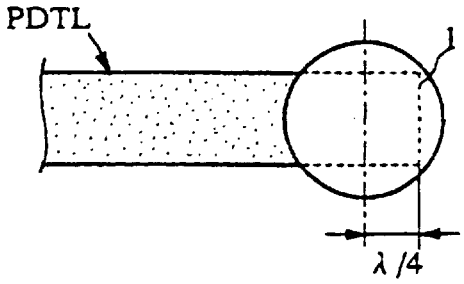
FIG. 4
FIG. 5
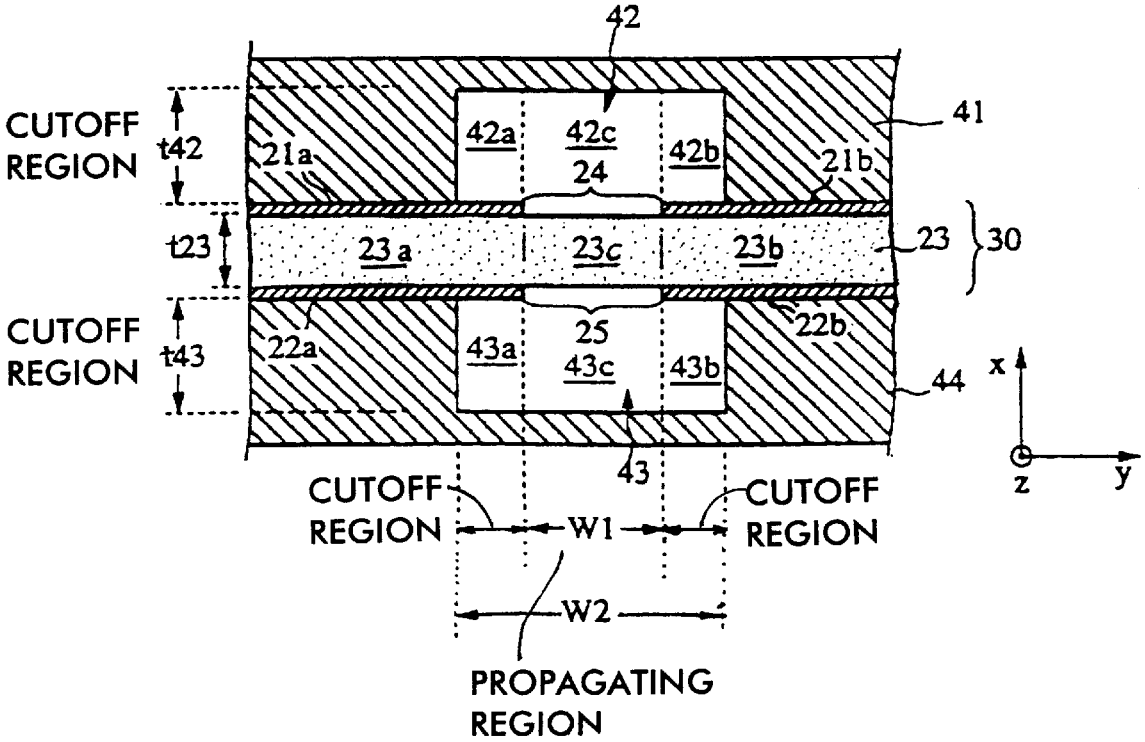

ANTENNA DEVICE AND RADAR MODULE

BACKGROUND OF THE INVENTION

1. Field of the Invention

The present invention relates to an antenna device and a radar module used in the millimeter wave range.

2. Description of the Related Art

As for transmission lines for use in the microwave and millimeter-wave ranges, waveguides, coaxial transmission lines, and transmission lines of the type comprising a conductor formed on a dielectric substrate, such as microstrip transmission lines, coplanar transmission lines and slot transmission lines, are widely used. When a transmission line is formed on a dielectric substrate, it is possible to easily connect the transmission line to another electronic component such as an integrated circuit. Taking this advantage, a various kinds of integrated circuits are formed by mounting electronic components on a dielectric substrate.

As for antennas for use in the millimeter-wave range, waveguide horn antennas and microstrip line patch antennas are used.

Microstrip transmission lines, coplanar transmission lines, and slot transmission lines have a rather large transmission loss, and thus they are not suitable for use in circuits which need a low transmission loss. To solve the above problem, the applicant for the present invention has filed a patent in terms of planar dielectric transmission line and an integrated circuit which is disclosed in laid-open Japanese Patent Application No. 8-265007.

When this planar dielectric transmission line is used to form an antenna device for use in for example a millimeter-wave radar installed on a car, the transmission mode is converted to a waveguide mode so as to form a waveguide horn antenna, or is converted to a microstrip line transmission mode via a coplanar transmission mode whereby a signal is supplied to a microstrip line patch antenna. However, the advantages of being low in the transmission loss and small in the size provided by the planar dielectric transmission line are lost because the use of a transmission converter for achieving the transmission mode conversion causes an increase in the total volume of the module, and a loss occurs when an RF signal passes through the transmission converter, which results in a reduction in the antenna efficiency. Another problem is that a complicated assembling process is needed. Furthermore, the repeatability of the characteristics becomes poor. As a result, the total cost increases.

SUMMARY OF THE INVENTION

It is a general object of the present invention to solve the above problems. More specifically, it is an object of the present invention to provide an antenna device capable of being coupled, in a highly efficient fashion, to a planar dielectric transmission line and also capable of being formed into the form of a module including a planar dielectric transmission line.

It is another object of the present invention to provide a small-sized and high-efficiency radar module taking the advantages of the planar dielectric transmission line.

To achieve the above objects, the invention provides a technique of realizing an antenna which does not need transmission mode conversion from a planar dielectric transmission line to a waveguide or a microstrip line. More specifically, the present invention provides, in its one aspect, an antenna device comprising: a dielectric plate provided with two electrodes that are formed on its first principal surface in such a manner that the two electrodes are spaced a fixed distance apart so that a first slot is formed between the two electrodes, and also provided with another two electrodes that are formed on the second principal surface of the dielectric plate in such a manner that said another two electrodes are spaced a fixed distance apart so that a second slot is formed between said another two electrodes, the location of the second slot corresponding to the location of the first slot on the opposite side of the dielectric plate, the region of the dielectric plate between the first slot and the second slot serving as the propagating region of a planar dielectric transmission line through which a plane wave is transmitted; and a dielectric resonator that is disposed on the end of or in the middle of the planar dielectric transmission line so that the planar dielectric transmission line is coupled with the dielectric resonator and so that the dielectric resonator serves as a primary radiator. In this antenna device, the region of the dielectric plate between the first slot and the second slot formed on both principal surfaces of the dielectric plate acts as the propagating region of the planar dielectric transmission line through which a plane wave is transmitted. The dielectric resonator, that is located at the end of or in the middle of this planar dielectric transmission line and coupled with the planar dielectric transmission line, acts as the primary radiator. For example, if a dielectric resonator in the form of a circular column that operates in the TE01δ mode or HE111 mode is employed, an electromagnetic wave is radiated from the dielectric resonator in a direction along the axis thereof. When the antenna device is used as a transmission antenna, the electromagnetic wave propagating in the TE mode or LSM mode through the planar dielectric transmission line is directly converted into the TE010 mode of the dielectric resonator, and the electromagnetic wave is radiated in the direction along the axis of the dielectric resonator. Conversely, when an electromagnetic wave is incident on the dielectric resonator in the direction along its axis, the dielectric resonator resonates in the TE010 mode, and the electromagnetic wave is directly converted to the TE mode or the LSM mode of the planar dielectric transmission line and propagates through the planar dielectric transmission line.

According to another aspect of the invention, there is provided an antenna device comprising: a dielectric plate provided with two electrodes that are formed on its first principal surface in such a manner that the two electrodes are spaced a fixed distance apart so that a first slot is formed between the two electrodes, and also provided with another two electrodes that are formed on the second principal surface of said dielectric plate in such a manner that said another two electrodes are spaced a fixed distance apart so that a second slot is formed between said another two electrodes, the location of the second slot corresponding to the location of the first slot on the opposite side of the dielectric plate, the region of the dielectric plate between the first slot and the second slot serving as the propagating region of a planar dielectric transmission line through which a plane wave is transmitted; and a dielectric resonator formed of a part of the dielectric plate, said two electrodes and said another two electrodes being not formed on said part, the dielectric resonator being located on the end of or in the middle of the planar dielectric transmission line; and another dielectric resonator disposed on the end of or in the middle of the planar dielectric transmission line so that said another dielectric resonator serves as a primary radiator. In this antenna device, the part of the dielectric plate where no electrodes are formed acts as a dielectric resonator which is coupled with the planar dielectric transmission line. There is provided another dielectric resonator on the former dielectric resonator formed in the dielectric plate so that the dielectric resonator is coupled with said another dielectric resonator disposed thereon and thus the dielectric resonator acts as the primary radiator.

A slot, that is adapted to resonate at a frequency substantially equal to the resonance frequency of the dielectric resonator, may be disposed in the vicinity of the dielectric resonator so that the polarization plane of an electromagnetic wave that is received or transmitted is defined by the slot.

The dielectric resonator may include two piecies that are disposed on the first and second principal surfaces, respectively, of the planar dielectric transmission line in such a manner that the two piecies are disposed at the same location but on the opposite sides of the planar dielectric transmission line so that the structure on one principal surface of the dielectric plate becomes symmetric to the structure on the other principal surface thereby achieving enhanced coupling between the planar dielectric transmission line and the dielectric resonator.

Furthermore, a dielectric lens may be disposed so that the center axis of the dielectric lens is substantially coincident with the center axis of the dielectric resonator and so that the focal point of the dielectric lens is substantially coincident with the location of the dielectric resonator thereby improving the directivity and the gain of the antenna device.

According to still another aspect of the invention, there is provide a radar module comprising: an antenna device according to any aspect of the invention; an oscillator for generating a signal to be radiated via the antenna device; and a mixer for mixing a signal received via the antenna device with a local signal.

BRIEF DESCRIPTION OF THE DRAWINGS

FIG. 4 is a partial plan view illustrating the positional relationship between the planar dielectric transmission line and the dielectric resonator of the antenna device;

FIG. 5 is a cross-sectional view of the planar dielectric transmission line;

DESCRIPTION OF THE PREFERRED EMBODIMENTS

Figure 1:
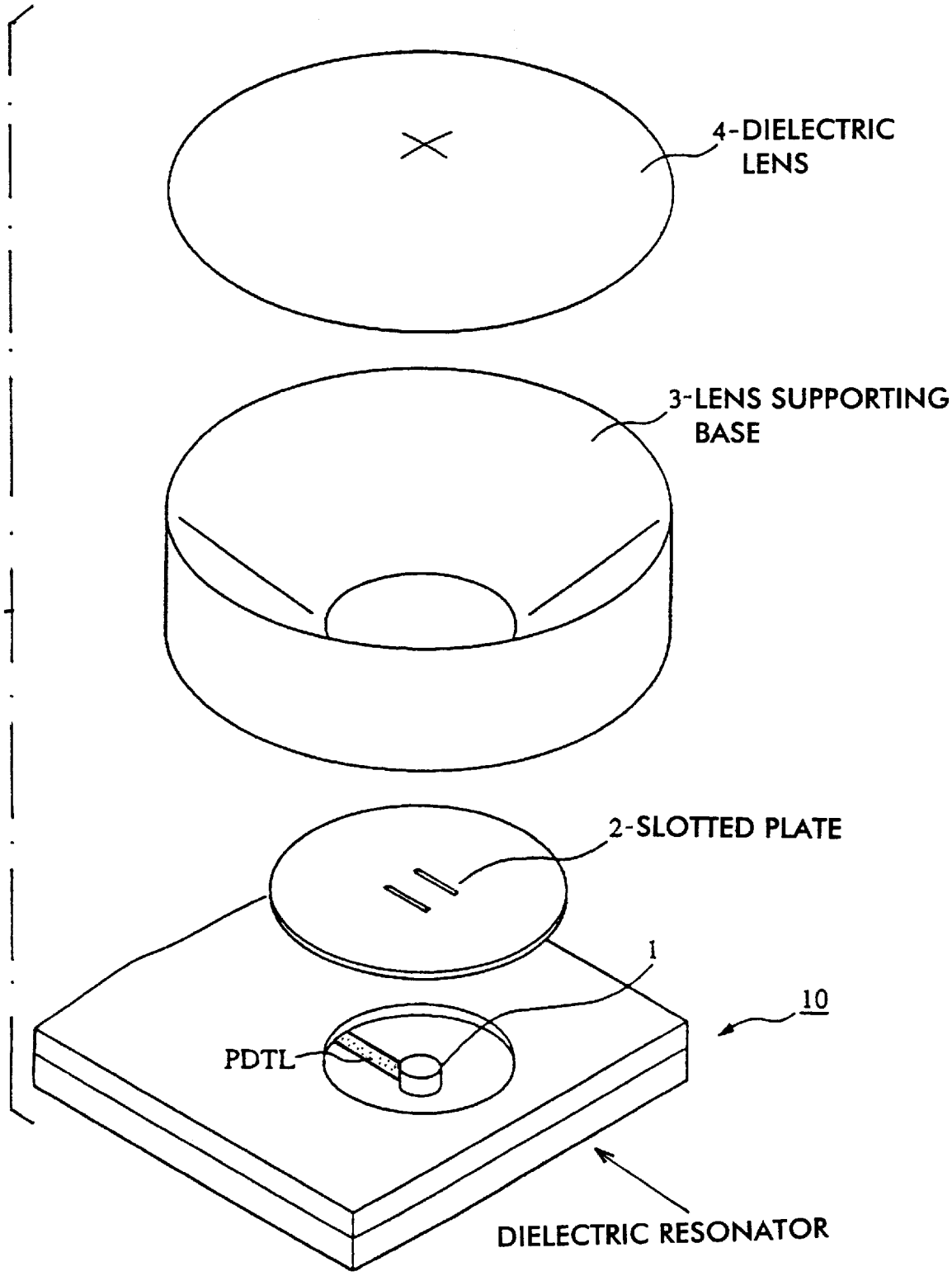
FIG. 1 is an exploded perspective view of a first embodiment of an antenna device according to the invention.

The structure of an antenna device according to a first embodiment of the invention is described below with reference to FIGS. 1 to 7.

First, the structure of the planar dielectric transmission line is described below. The planar dielectric transmission line has a structure similar to a double-slot structure (having two slots formed in a symmetric fashion on both sides of a dielectric plate) according to a conventional technique. However, the operation of this planar dielectric transmission line is based on a principle absolutely different from that of the double-slot structure. In this sense, the planar dielectric transmission line according to the present invention is absolutely different from the double-slot structure. FIG. 5 is a cross-sectional view of the planar dielectric transmission line, taken along a plane perpendicular to the signal propagation direction. In FIG. 5, reference numeral 23 denotes a dielectric plate. Two conductors 21*a* and 21*b* are formed on its first principal surface (the surface on the upper side in FIG. 5) so that a first slot is formed between the two conductors 21*a* and 21*b*. Furthermore, two conductors 22*a* and 22*b* are formed on a second principal surface (the surface on the upper side in FIG. 5) of the dielectric plate 23 so that a second slot is formed between the two conductors 22*a* and 22*b*. There are provided two conductive plates 41 and 44 having cavities 42 and 43, respectively, formed in the immediate vicinities of the slots 24 and 25, respectively. The conductors 21*a* and 21*b* are electrically connected to each other through the conductive plate 41, and the conductors 22*a* and 22*b* are electrically connected to each other through the conductive plate 44.

In FIG. 5, the portion, denoted by reference numeral 23*c*, of the dielectric plate 23 between the two slots 24 and 25 located on the opposite sides serves as a propagating region through which a high frequency signal having a transmission frequency fb is transmitted. The portions 23*a* and 23*b* on both sides of the propagating region 23*c* serve as cutoff regions.

Figure 6:
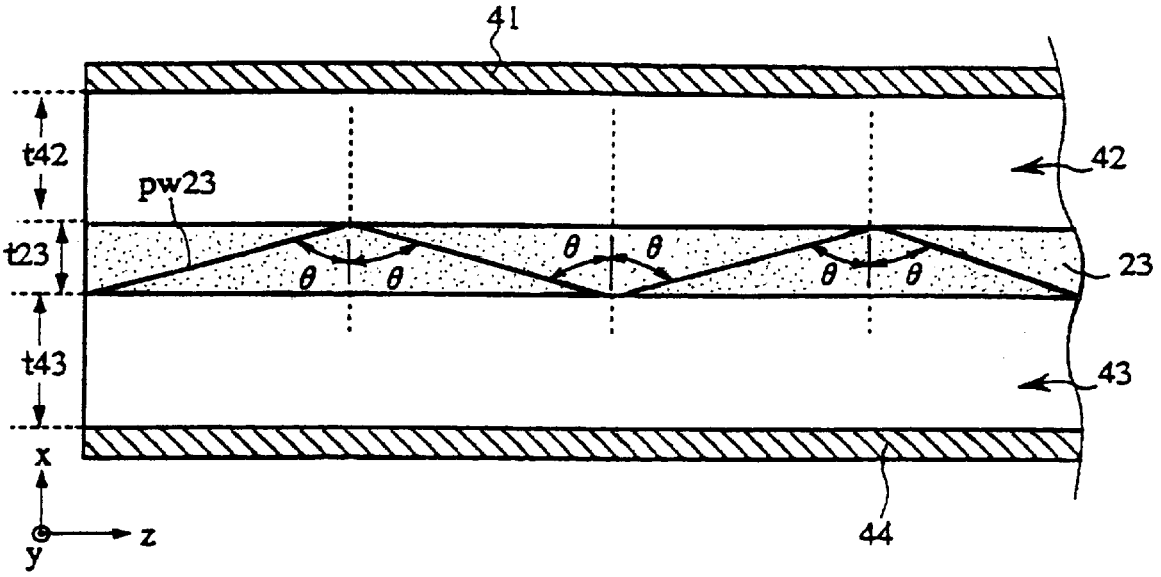
FIG. 6 is a cross-sectional view of the planar dielectric transmission line.

FIG. 6 is a cross-sectional view of the planar dielectric transmission line of FIG. 5, taken along a plane passing through the propagating region in a direction parallel to the signal transmission direction. As shown in FIG. 6, a plane-polarized electromagnetic wave pw23 is incident at a particular incidence angle θ on the upper surface (in the area where the slot 24 is formed) of the dielectric plate 23 and is reflected at a reflection angle θ equal to the incidence angle θ. The plane-polarized electromagnetic wave pw23 reflected from the upper surface of the dielectric plate 23 is then incident at an incidence angle θ on the lower surface (in the area where the slot 25 is formed) of the dielectric plate 23 and is reflected at a reflection angle θ equal to the incidence angle θ. Furthermore, the plane-polarized electromagnetic wave 23 is repeatedly reflected alternately at both boundary surfaces of the dielectric plate 23 in the areas where the slots 24 and 25 are formed, thus the plane-polarized electromagnetic wave 23 propagates in the TE mode through the propagating region 23*c* of the dielectric plate 23. In other words, the dielectric constant and the thickness t23 of the dielectric plate 23 are selected so that the desired transmission frequency fb becomes higher than the critical frequency fda (at which the incidence angle θ becomes small enough for the plane-polarized electromagnetic wave pw23 to transmit into the cavity space 42 or 43 thus resulting in attenuation of the plane-polarized electromagnetic wave pw23 propagating through the propagating region 23*c*).

Referring again to FIG. 5, the electrodes 21*a* and 22*a* provided on the opposite sides of the dielectric plate 23 form a parallel plane waveguide whose cut-off frequency for the TE waves is sufficiently high compared to the desired transmission frequency fb so that one side portion, extending along the longitudinal direction of the dielectric plate 23 and sandwiched between the electrodes 21*a* and 22*a*, of the dielectric plate 23 acts as the cutoff region 23*a* through which TE waves having an electric field component parallel to the electrodes 21*a* and 22*a* cannot propagate. Similarly, the electrodes 21*b* and 22*b* provided on both sides of the dielectric plate 23 form a parallel plate waveguide whose cut-off frequency for the TE waves is sufficiently high compared to the desired transmission frequency fb so that the other side portion, extending along the longitudinal direction of the dielectric plate 23 and sandwiched between the electrodes 21*b* and 22*b*, of the dielectric plate 23 acts as the cutoff region 23*b* through which TE waves cannot propagate.

In the cavity space 42, a parallel plane waveguide is formed between the ceiling of the cavity 42 and the electrode 21*a*. The thickness t42 of this parallel plane waveguide is selected so that this parallel plane waveguide has a TE-wave cut-off frequency sufficiently high compared to the desired transmission frequency fb thereby forming a cutoff region 42*a* through which the TE waves cannot propagate. Similarly, cutoff regions 42*b*, 43*a*, and 43*b* for blocking the TE waves are formed.

The inner walls (vertical walls in FIG. 5) located on opposite sides of the cavity 42 form a parallel plane waveguide. The width W2 of this parallel plane waveguide is selected so that the TE-wave cut-off frequency of this parallel plane waveguide is sufficiently high compared to the desired transmission frequency fb thereby forming a cutoff region cutoff region. Similarly, a cutoff region 43*d* is formed in the cavity 43.

In the planar dielectric transmission line having the above-described structure, the electromagnetic energy of a high frequency signal having a frequency higher than the critical frequency fda is confined within the propagating region 23*c* and its vicinity so that the plane wave is transmitted through the propagating region of the dielectric plate 23 in the longitudinal direction (z direction).

When it is desired to transmit a signal in the 60 GHz band, if the dielectric plate 23 has a relative dielectric constant of 20 to 30 and a thickness t23 of 0.3 to 0.8 $\mu$m, then the width W1 of the transmission line is selected to 0.4 to 1.6 mm. In this case, the characteristic impedance becomes 30 to 200 Ω. If a dielectric plate having a relative dielectric constant equal to or greater than 18 is employed, 95% or greater part of energy is confined within the dielectric plate and thus it is possible to realize a transmission line through which electromagnetic waves propagates by means of total reflection with an extremely low loss.

Figure 7:
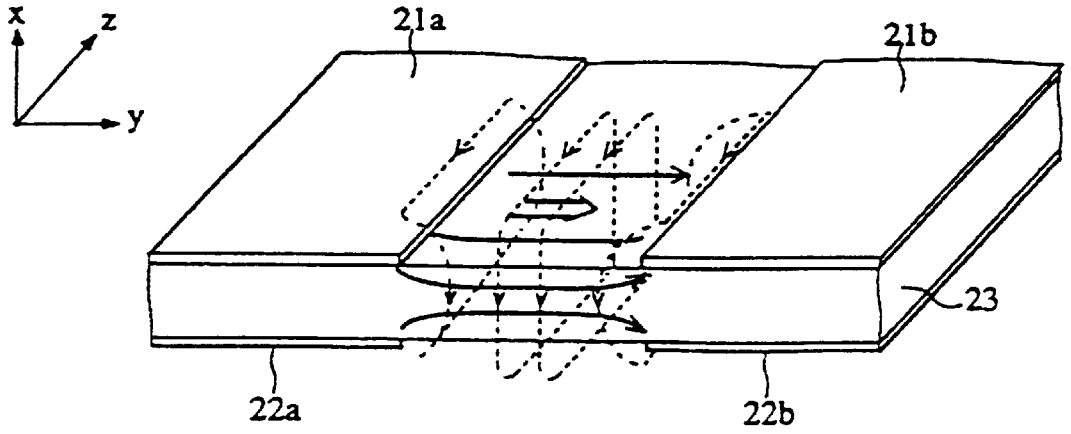
FIG. 7 is a schematic representation of the electromagnetic field distribution in the planar dielectric transmission line.

FIG. 7 illustrates the electromagnetic field distribution of a signal propagating through the planar dielectric transmission line described above. In FIG. 7, the solid lines represent the electric field distribution and the broken lines represent the magnetic field distribution. As shown in FIG. 7, the energy of the electromagnetic wave is confined within the dielectric plate and the electromagnetic wave propagates in the TE mode or in a mode called an LSM mode.

Figure 2:
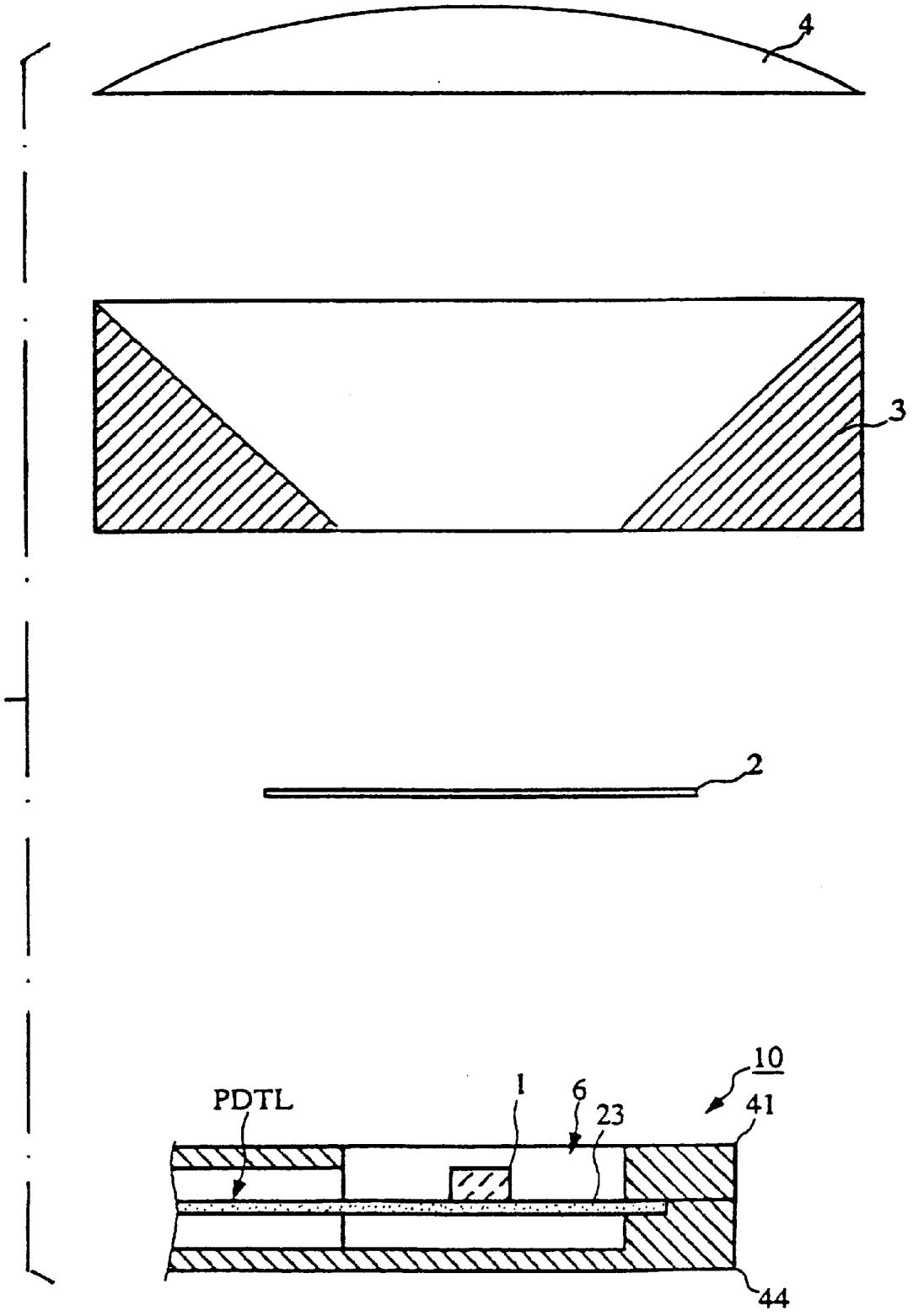
FIG. 2 is an exploded front view of the antenna device.
Figure 3:
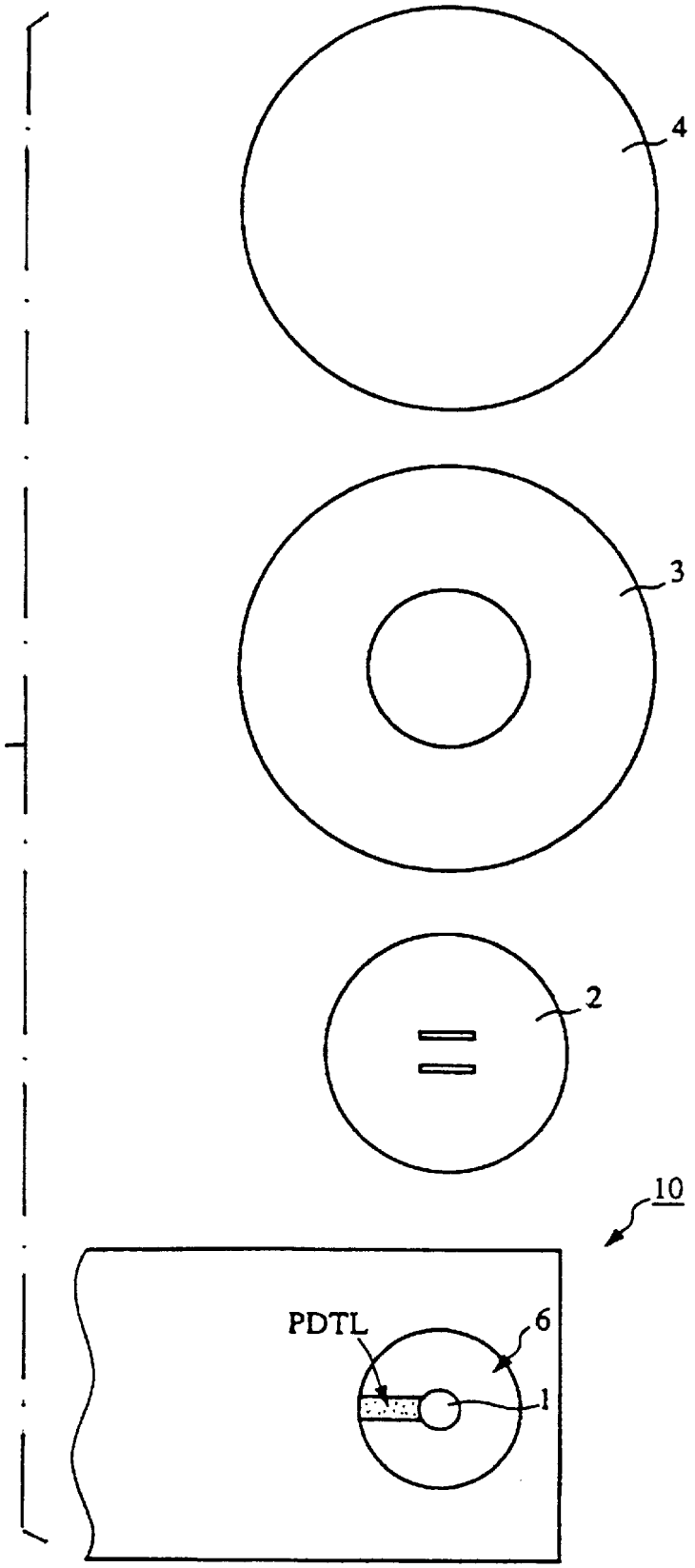
FIG. 3 is a plan view illustrating the various parts of the antenna device.

FIG. 1 is an exploded perspective view of an antenna device. As shown in FIG. 1, the antenna device comprises: an antenna module 10 which is the main part of the antenna device; a slotted plate 2 made by forming two slots in a metal plate; a dielectric lens 4; and a lens supporting base 3 for supporting the dielectric lens 4 at a desired height. The antenna device is constructed by placing these elements one on another. FIG. 2 is an exploded front view of the antenna device wherein the antenna module 10 and the dielectric lens supporting base 2 are represented in the form of cross-sectional views. The plan view of each element is shown in FIG. 3. The antenna module 10 comprises: an upper conductive plate 41 having an opening 6; and a lower conductive plate 44; a dielectric plate 23 disposed between the upper and lower conductive plates 41 and 44 so that a planar dielectric transmission line (hereinafter referred to simply as a PDTL) of the type described above is formed; and a dielectric resonator 1 located at the center of the opening 6 of the upper conductive plate 41 and at the end of the PDTL. In FIG. 2, the conductors formed on both principal surfaces of the dielectric plate 23 are not shown.

FIG. 4 is a partial plan view illustrating the relationship in terms of positions in a horizontal plane between the PDTL and the dielectric resonator 1. In this specific example, the electromagnetic wave to be received by the antenna device is assumed to have a frequency of 60 GHz, and the dielectric plate has a thickness of a 0.3 mm, the width of the slots is set to 0.8 to 1.6 mm, and a dielectric material having a relative dielectric constant of 24 is employed as the material of the dielectric plate. In this case, the characteristic impedance of the PDTL becomes 100 to 200 Ω. The end of the PDTL is short-circuited. The dielectric resonator 1 is placed in such a manner that the distance between the center of the dielectric resonator 1 and the end of the PDTL is equal to about $\lambda/4$ (where $\lambda$ is the wavelength of the electromagnetic wave propagating through the PDTL). The dielectric resonator 1 is formed of a dielectric material having a relative dielectric constant of 10 so that it has a diameter of about 2.2 mm and a thickness of about 1.3 mm. In this antenna device, the dielectric resonator 1 operates in the TE01δ mode. The diameter of the openeing 6 shown in FIG. 3 is about 7.5 mm. The width of the two slots formed in the slotted plate 2 shown in FIGS. 1 and 3 is about 0.2 mm and the length thereof is about 2.5 mm ($=\lambda/2$). These two slots are spaced about 2.4 mm apart. The diameter of the dielectric lens 4 is about 20 mm and its thickness is about 2.3 mm. The dielectric lens 4 is made of a dielectric material having a relative dielectric constant of 12, and a matching layer is formed on the surface of the dielectric lens 4. The thickness of the lens supporting base 3 is set to about 6 mm so that the focusing position of the dielectric lens 4 corresponds to the height of the slotted plate 2 or the height of the dielectric resonator 1.

Of the elements described above, the slotted palte 2 and the dielectric resonator 1 form a primary radiator, and the slotted plate 2 and the antenna module 10 form a slot antenna. That is, when the electromagnetic wave propagating through the PDTL is coupled with the dielectric resonator 1, the enegy of the electromagnetic wave is expanded in a direction along the axis of the dielectric resonator 1 and is radiated into the space through the slots of the slotted plate. In this state, an antenna gain of about 10 dB can be achieved. If the dielectric lens 4 is placed on the slot antenna via the lens supporting base 3, the antenna gain increases to about 20 dB.

The slotted plate 2 is provided so that an electromagnetic wave having a principal polarization plane perpendicular to the slots is selectively transmitted or received. When the antenna device is used as an antenna of a millimeter-waver radar installed on a car, the primary radiator may be placed so that the slots are oriented in a direction at an angle of 45° with respect to the ground thereby preventing the antenna from receiving electromagnetic waves from cars running in an opposite direction.

Although the dielectric resonator which operates in the TE01δ mode is employed in the antenna device described above, a dielectric resonator which operates in the HE111 mode may also be employed.

Figure 8:
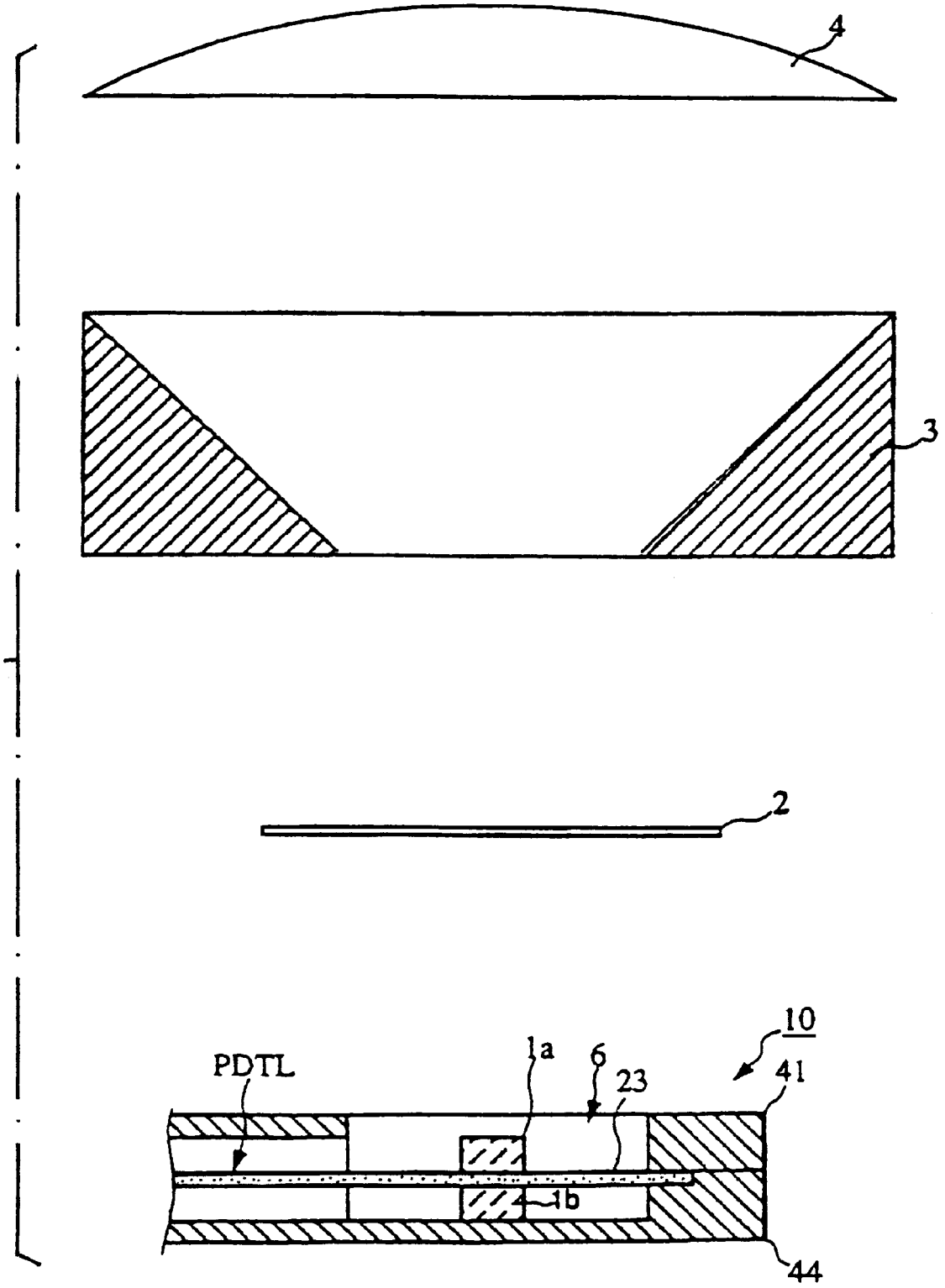
FIG. 8 is an exploded front view of a second embodiment of an antenna device according to the invention.

FIG. 8 is an exploded schematic diagram illustrating the structure of an antenna device according to a second embodiment of the invention. The elements shown in FIG. 8 correspond to the elements of the first embodiment shown in FIG. 1. This second embodiment is different from the first embodiment in that two dielectric resonators 1*a* and 1*b* in the form of a circular column are disposed on both principal surfaces of the dielectric plate 23 so that the dielectric plate 23 is sandwiched by the dielectric resonators 1*a* and 1*b*. The diameter of the dielectric resonator 1*a* is about 3.6 mm and the thickness thereof is about 1.3 mm. The diameter of the dielectric resonator 1*b* is about 3.6 mm and the thickness thereof is about 0.8 mm. Both dielectric resonators 1*a* and 1*b* are made of a dielectric material having a relative dielectric constant of 3.6. The PDTL is coupled with both dielectric resonators 1*a* and 1*b*, and the two dielectric resonators 1*a* and 1*b* are coupled with each other via the dielectric plate 23. As a result, the coupling between the PDTL and the dielectric resonator serving as the primary radiator is enhanced.

Figure 9:
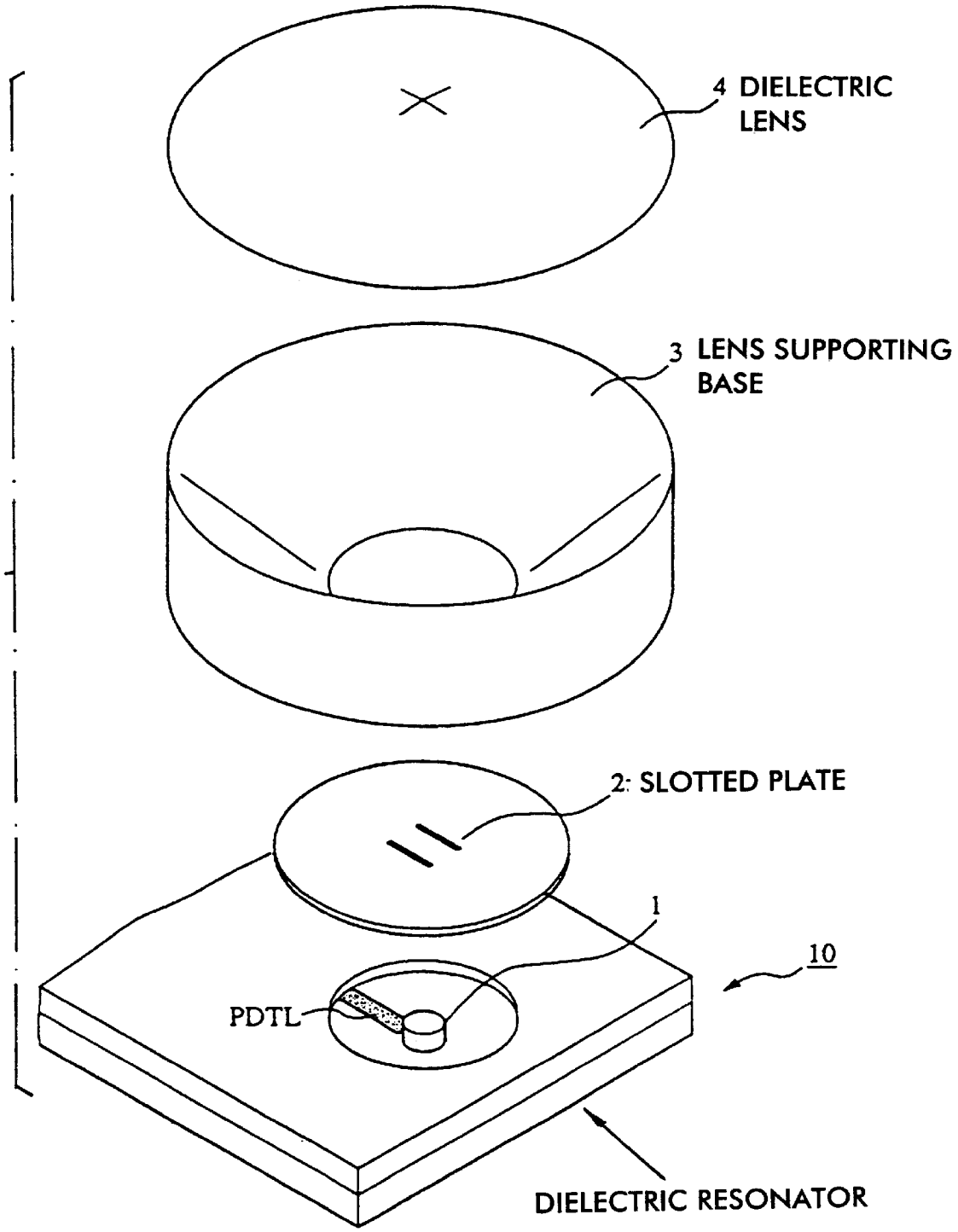
FIG. 9 is an exploded perspective view of a third embodiment of an antenna device according to the invention.
Figure 10A:
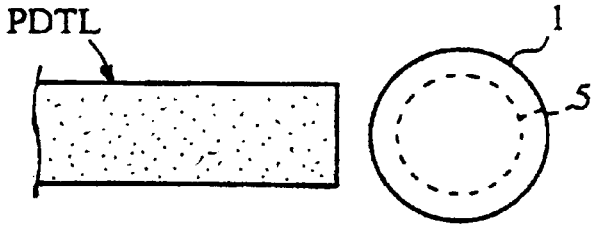
FIGS. 10A and 10B are schematic views representing, in the form of a plan view and a cross-sectional view, the dielectric resonator of the antenna device.
Figure 10B:
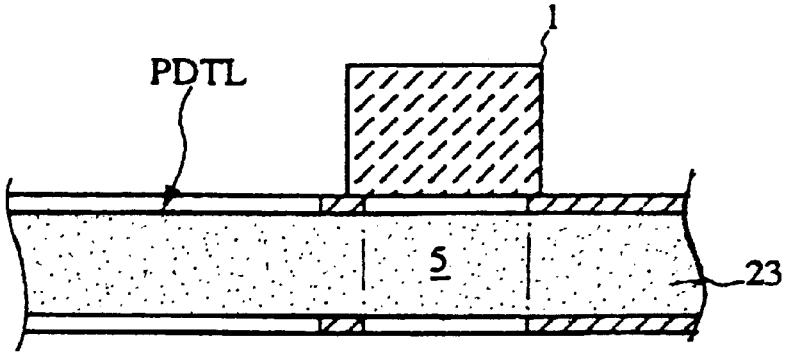

FIG. 9 is an exploded perspective view of an antenna device according to a third embodiment of the invention. FIG. 10 is a plan view illustrating the structure of the dielectric resonator used in this antenna device. This third embodiment is different from the first embodiment in that a dielectric resonator is formed in the dielectric plate and another dielectric resonator is disposed on the former dielectric resonator. In FIG. 10, the portion denoted by reference numeral 5 has no electrode on either principal surface of the dielectric plate 23 and thus this portion 5 acts as a dielectric resonator which operates in the TE010 mode. The end of the electrodes forming the PDTL is separated from the TE010-mode dielectric resonator by an adequate distance which allows the PDTL to be coupled with the dielectric resonator to a sufficient degree. Thus, this dielectric resonator is magnetically coupled with the PDTL. The other dielectric resonator 1 in the form of a circular column which operated in the TE01δ mode is disposed on the dielectric resonator 5 formed in the portion of the dielectric plate having no electrodes so that the dielectric resonator 1 and the dielectric resonator 5 are coupled with each other via both magnetic field coupling and electric filed coupling. In this antenna device having the above structure, the electromagnetic wave propagating through the PDTL is coupled with the dielectric resonator 5 formed in the dielectric plate which is coupled with the dielectric resonator 1 disposed on the dielectric plate, and thus the electromagnetic wave is radiated in a direction along the axis of the resonators. Conversely, when an electromagnetic wave is received by the antenna device, the electromagnetic wave incident in the direction along the axis of the dielectric resonator 1 causes the dielectric resonator 1 to resonate in the TE01δ mode. As a result, the dielectric resonator 5 formed in the dielectric plate resonates in the TE010 mode, and the electromagnetic wave propagates through the PDTL in the TE mode or in the LSM mode.

Now an embodiment of a millimeter-wave radar module is described below with, reference to FIG. 11.

Figure 11:
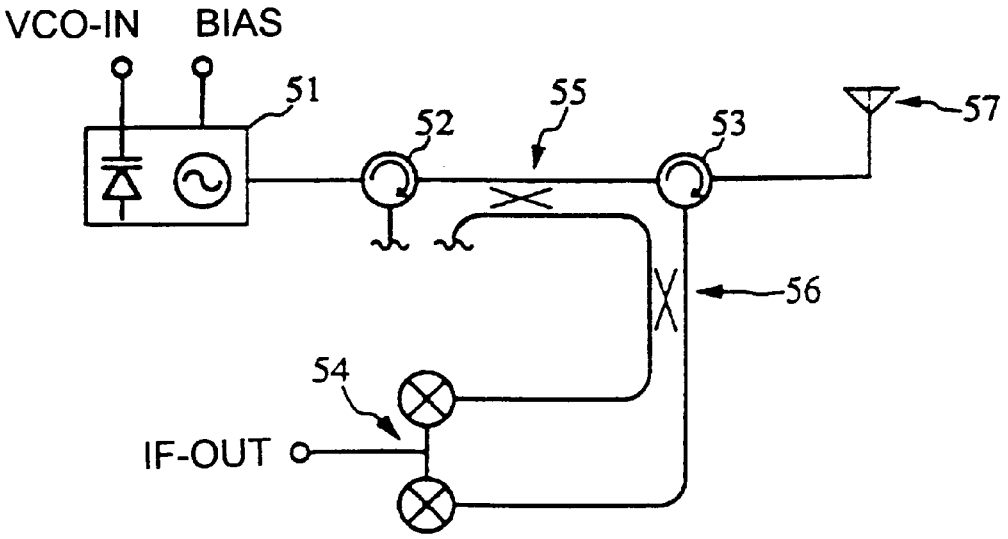
FIG. 11 is an equivalent circuit diagram of a millimeter-waver radar module.

FIG. 11 is an equivalent circuit of the millimeter-wave radar module. In FIG. 11, the circuit includes an oscillator 51, circulators 52 and 53, a mixer 54, couplers 55 and 56, and an antenna 57. The oscillator 51 is of the voltage controlled oscillator (VCO) comprising a Gunn diode serving as an oscillating device and a varactor diode serving as a device for controlling the oscillation frequency. A bias voltage to the Gunn diode and a frequency control voltage VCO-IN are input to the oscillator 51. One output port of the circulator 52 is terminated with a resistor so that no signal is reflected toward the oscillator 51. The circulator 53 transfers the signal to be radiated to the antenna 57 while the circulator 53 transfers the received signal to the mixer 54. An antenna 57 is formed of a dielectric resonator and a dielectric lens based on any technique disclosed in the first through third embodiments described above. The coupler 55 is used to couple the transmission signal with the local signal. The coupler 56 is made up of a 3 dB directional coupler and serves to transfer the local signal from the coupler 55 equally into two transmission lines connected to the mixer 54 so that the local signals on the two transmission lines have a phase difference of 90° and transfer the received signal from the circulator 53 equally into the two transmission lines connected to the mixer 54 so that the signals on the two transmission lines have a phase difference of 90°. The mixer 54 is made up of a Schottky barrier diode for operating a balanced mixing operation on the two signals thereby creating an IF signal having a frequency equal to the difference between the frequency of the received signal and the frequency of the local signal.

Using the millimeter-wave radar module, an FM-CW millimeter-waver radar may be realized in which for example a signal with a triangular waveform is applied as the VCO-IN signal, and distance information and relative velocity information are extracted from the IF signal. This radar may be installed on a car so as to detect the relative distance to another car and detect the relative velocity of the car.

In the radar module of the invention, the essential requirement is that at least the dielectric resonator serving as the primary radiator of the antenna 57 be coupled with the planar dielectric transmission line. As for the transmission lines among other elements such as the oscillator 1, the circulators 52 and 53, and the mixer 54, another type of transmission line such as a slot transmission line, coplanar transmission line, a microstrip line, or a dielectric transmission line may also be employed instead of the planar dielectric transmission line.

As described above, in the antenna device according to the present invention, the region of the dielectric plate between the first slot and the second slot formed on both principal surfaces of the dielectric plate acts as the propagating region of the planar dielectric transmission line through which a plane wave is transmitted. The dielectric resonator is disposed at the end of or in the middle of this planar dielectric transmission line so that the dielectric resonator is directly or indirectly coupled with the planar dielectric transmission line and thus the dielectric resonator acts as the primary radiator. Thus, it is possible realize an antenna device in which the signal propagating through the planar dielectric transmission line is directly transferred to the primary radiator without having to perform transmission mode conversion from the planar dielectric transmission line to a coplanar transmission line, a microstrip transmission line, or a waveguide transmission line. Therefore, no transmission convertor for performing transmission mode conversion is required in the present invention, and thus no loss of the RF signal due to the transmission mode conversion occurs. As a result, it is possible to achieve a high antenna efficiency. Another advantage is that the antenna device can be assembed easily. Furthermore, the repeatability of the characteristics is improved, and the total cost is reduced.

In another aspect of the invention, the polarization plane of the transmitted and received electromagnetic wave is defined by the slot in a desired fashion.

In still another aspect of the invention, the portion on one principal surface of the dielectric plate has a structure symmetric to the structure of the portion on the other principal surface of the dielectric plate. This allows the planar dielectric transmission line to be coupled more tightly with the dielectric resonator.

In still another aspect of the invention, the directivity and the gain of the antenna can be enhanced.

In still another aspect of the invention, a small-sized and high-efficiency radar module can be realized taking the advantage of being low in the loss provided by the planar dielectric transmission line. That is, it is possible to realize a millimeter-waver radar with a reduced size.

What is claimed is:

1. An antenna device comprising:

a dielectric plate provided with two electrodes that are formed on its first principal surface in such a manner that said two electrodes are spaced a fixed distance apart so that a first slot is formed between said two electrodes, and also provided with another two electrodes that are formed on the second principal surface of said dielectric plate in such a manner that said another two electrodes are spaced a fixed distance apart so that a second slot is formed between said another two electrodes, the location of said second slot corresponding to the location of said first slot on the opposite side of said dielectric plate, the region of said dielectric plate between the first slot and the second slot serving as the propagating region of a planar dielectric transmission line through which a plane wave is transmitted; and a dielectric resonator that is disposed on the end of or in the middle of said planar dielectric transmission line so that said planar dielectric transmission line is coupled with said dielectric resonator and so that said dielectric resonator serves as a primary radiator.

2. An antenna device comprising:

a dielectric plate provided with two electrodes that are formed on its first principal surface in such a manner that said two electrodes are spaced a fixed distance apart so that a first slot is formed between said two electrodes and also provided with another two electrodes that are formed on the second principal surface of said dielectric plate in such a manner that said another two electrodes are spaced a fixed distance apart so that a second slot is formed between said another two electrodes, the location of said second slot corresponding to the location of said first slot on the opposite side of said dielectric plate, the region of said dielectric plate between the first slot and the second slot serving as the propagating region of a planar dielectric transmission line through which a plane wave is transmitted;

a dielectric resonator formed of a part of said dielectric plate, said two electrodes and said another two electrodes being not formed on said part, said dielectric resonator being located on the end of or in the middle of said planar dielectric transmission line; and another dielectric resonator disposed on the end of or in the middle of said planar dielectric transmission line so that said another dielectric resonator serves as a primary radiator.

3. An antenna device according to claim 1, further comprising a slot disposed in the vicinity of said dielectric resonator, said slot being adapted to resonate at a frequency substantially equal to the resonance frequency of said dielectric resonator.

4. An antenna device according to claims 1, wherein said dielectric resonator includes two piecies that are disposed on the first and second principal surfaces, respectively, of said planar dielectric transmission line in such a manner that said two piecies are disposed at the same location but on the opposite sides of said planar dielectric transmission line.

5. An antenna device according to claims 1, further comprising a dielectric lens disposed so that the center axis of said dielectric lens is substantially coincident with the center axis of said dielectric resonator and so that the focal point of said dielectric lens is substantially coincident with the location of said dielectric resonator.

6. A radar module comprising:

an antenna device including;

a dielectric plate provided with two electrodes that are formed on its first principal surface in such a manner that said two electrodes are spaced a fixed distance apart so that a first slot is formed between said two electrodes, and also provided with another two electrodes that are formed on the second principal surface of said dielectric plate in such a manner that said another two electrodes are spaced a fixed distance apart so that a second slot is formed between said another two electrodes, the location of said second slot corresponding to the location of said first slot on the opposite side of said dielectric plate, the region of said dielectric plate between the first slot and the second slot serving as the propagating region of a planar dielectric transmission line through which a plane wave is transmitted; and a dielectric resonator that is disposed on the end of or in the middle of said planar dielectric transmission line so that said planar dielectric transmission line is coupled with said dielectric resonator and so that said dielectric resonator serves as a primary radiator;

an oscillator for generating a signal to be radiated via said antenna device; and a mixer for mixing a signal received via said antenna device with a local signal.

* * * * *